US009045957B2

(12) United States Patent
Yajure

(10) Patent No.: US 9,045,957 B2
(45) Date of Patent: Jun. 2, 2015

(54) RESONANT EXTRACTOR SYSTEM AND METHOD

(75) Inventor: Edgar Fernando Yajure, Calgary (CA)

(73) Assignee: TESCO CORPORATION, Houston, TX (US)

( * ) Notice: Subject to any disclaimer, the term of this patent is extended or adjusted under 35 U.S.C. 154(b) by 652 days.

(21) Appl. No.: 13/315,096

(22) Filed: Dec. 8, 2011

(65) Prior Publication Data

US 2013/0146360 A1 Jun. 13, 2013

(51) Int. Cl.
*E21B 7/24* (2006.01)
*E21B 31/00* (2006.01)

(52) U.S. Cl.
CPC ..... *E21B 31/005* (2013.01); *E21B 7/24* (2013.01)

(58) Field of Classification Search
CPC ..... E21B 31/005; E21B 7/24; E21B 31/00; E21B 17/073; F16D 3/76
USPC ..... 175/55, 56, 135, 189; 166/177.6
See application file for complete search history.

(56) References Cited

U.S. PATENT DOCUMENTS 2,641,927 A 6/1953 Grable et al,
2,972,380 A 2/1961 Bodine, Jr.
4,384,625 A 5/1983 Roper et al.
4,553,443 A * 11/1985 Rossfelder et al. ..... 74/22 R
4,576,229 A 3/1986 Brown
5,409,070 A * 4/1995 Roussy ..... 173/49
5,456,325 A * 10/1995 Pantermuehl et al. ..... 175/6
5,476,421 A * 12/1995 Moore et al. ..... 464/20
5,540,295 A 7/1996 Serrette
5,549,170 A * 8/1996 Barrow ..... 175/55
5,685,615 A * 11/1997 Bechem et al. ..... 299/110
6,009,948 A 1/2000 Flanders et al.
6,412,560 B1 7/2002 Bernat
6,550,536 B2 4/2003 Bernat
6,691,778 B2 2/2004 Cole et al.
6,907,927 B2 6/2005 Zheng et al.
7,066,250 B2 6/2006 Webb et al.
7,264,055 B2 9/2007 Mody et al.
7,461,705 B2 12/2008 Hulick et al.

(Continued)

FOREIGN PATENT DOCUMENTS

GB 2332690 6/1999

OTHER PUBLICATIONS

PCT International Search Report & Written Opinion for International Application No. PCT/US2012/067429 mailed Jan. 21, 2014.

*Primary Examiner* — Nicole Coy
(74) *Attorney, Agent, or Firm* — Fletcher Yoder, P.C.

(57) ABSTRACT

A resonant extractor system configured to use rotational energy provided by a top drive system to apply vertical oscillating motion to attached tubular or drilling equipment. The extractor includes a rotational component, an oscillation component, and an assembly of engagement features. The top drive system may rotate the rotational component about a vertical axis. In certain embodiments, the rotational component is a housing, the oscillation component is a quill, and the engagement features include a cam disposed on a shaft. The shaft is coupled to and extends radially into the housing, and the cam disposed on the shaft, which features an eccentric geometry relative the shaft, maintains contact with a lip extending from the quill in the housing. As the housing rotates, the eccentric cam rotates, raising and lowering the quill, which is configured to couple with tubular or drilling equipment.

17 Claims, 6 Drawing Sheets

(56) References Cited

U.S. PATENT DOCUMENTS 7,757,783 B2 * 7/2010 Pfahlert ..... 175/56
8,342,263 B2 * 1/2013 Kejr et al. ..... 175/56
2006/0225922 A1 * 10/2006 Pfahlert ..... 175/56
2010/0139912 A1 * 6/2010 Pfahlert et al. ..... 166/177.6

* cited by examiner

RESONANT EXTRACTOR SYSTEM AND METHOD

BACKGROUND

Embodiments of the present disclosure relate generally to the field of drilling and processing of wells. More particularly, present embodiments relate to a system and method for extracting a tubular during a drilling process, a casing process, or another type of well processing operation.

In conventional oil and gas operations, a well is typically drilled to a desired depth with a drill string, which includes drill pipe and a drilling bottom hole assembly. During a drilling process, the drill string may be turned by a top drive, which uses one or more motors to turn a quill coupled to the upper tubular of the drill string. Occasionally, the bottom hole assembly may become stuck in a formation, especially if the drill string has remained stationary or mud has not been circulated through the well bore for a length of time. In addition, pressure differences between the drill string and the drilling formation may lead to an outer wall of the drill string pushing out against the well bore wall, thereby causing the drill string to become stuck in the well bore.

Extracting a stuck drill string typically involves delivering energy to the stuck point in either a discrete or continuous fashion. For the case of discrete energy delivery, the use of surface or down-hole jars is commonplace whereby energy is stored in the form of spring compression or pneumatic pressure and then released in a sudden fashion by the movement of a sliding mass coming to a sudden stop against a shoulder. For the case of continuous delivery of energy from the surface, devices exist capable of oscillating the drill string along its axis until the drill string becomes dislodged from the well bore. Such oscillating motion may also be beneficial during normal drilling operations in order to prevent the drill string from becoming stuck altogether. In traditional operations, oscillating motion may be induced on the drill string at the surface through a resonant vibrator, which applies a vertical oscillating force to the top of the drill string, wherein the force is generated by weights shifted with power from an auxiliary power source. In order to isolate this force from the top drive, the top drive is either removed from the mast or an isolation device is installed between the vibrator and the top drive.

BRIEF DESCRIPTION

It is now recognized that there exists a need for improved and different systems and methods for generating oscillating motion of drilling equipment to facilitate extraction of a drill string or the like. Accordingly, present embodiments are directed to component arrangements and methods that allow for oscillating a drill string using engagement surfaces that generate oscillatory movement. Certain disclosed embodiments include systems and methods for generating oscillating motion of drilling equipment using power from a top drive motor and without the use of an auxiliary power source. Indeed, certain disclosed embodiments of the present disclosure are directed to addressing the need for a technique that may allow for extraction or dislodging of a drill string or equipment using power provided directly from the top drive to components that rotate relative to a vertical axis.

In accordance with one aspect of the disclosure, a drilling system includes a rotational component configured to be coupled with a top drive, an oscillation component configured to be coupled with the rotational component, a first engagement feature of the rotational component, and a second engagement feature of the oscillation component. The top drive is configured to facilitate rotation of the rotational component about a vertical axis, and the oscillation component is configured to be coupled with tubular or equipment. The first and second engagement features are configured to abut one another and maintain contact such that during rotation of the rotational component the oscillation component is oscillated along the vertical axis.

Present embodiments also provide a method for using the rotation of a top drive quill to facilitate vertical oscillating motion of a tubular. In an exemplary embodiment, the method includes maintaining a coupling between a tubular or equipment and a quill disposed at least partially in a housing coupled to a top drive system. The method also includes rotating the housing about a vertical axis of the housing via the top drive system such that a shaft coupled to and extending into the housing substantially transverse the vertical axis revolves about the vertical axis of the housing. Still further, the method includes maintaining contact between an eccentric cam disposed on the shaft and a lip extending from the quill such that, as the shaft rotates about the vertical axis, the eccentric cam rotates about an axis of the shaft. Finally, the method includes facilitating oscillating movement of the quill and the tubular or equipment along an axis of the quill as the eccentric cam rotates.

In accordance with another aspect of the invention, a drilling system includes a rotational component configured to be coupled with a top drive, an oscillation component engaged with the rotational component, and assembly configured to maintain contact with both the rotational component and the oscillation component. The top drive facilitates rotation of the rotational component about a vertical axis, and the oscillation component is configured to be coupled with tubular or drilling equipment. The assembly is configured to facilitate vertical oscillatory motion of the oscillation component as the rotational component rotates.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a novel resonant extractor system and method that can be used in drilling operations. The presently disclosed techniques allow for a string of drill pipe to be extracted from a stuck position in a well bore using a system powered entirely by a top drive. In one embodiment, the top drive rotates a housing, which houses at least one shaft with an eccentric cam located on the shaft. The shaft is connected to the housing and extends radially into the housing such that, as the housing rotates about a vertical axis, the shaft revolves about the vertical axis. The eccentric cam is configured to maintain contact with a lip extending from a quill contained partially in the housing such that, as the housing rotates, the eccentric cam rotates about an axis of the shaft, which results in raising and lowering the quill. An end of the quill extending out of the housing is configured to be coupled with the drill string. Thus, as the top drive rotates the housing, the quill oscillates the drill string in the vertical direction. In another embodiment, the lip may include an asymmetric surface and the cam may be concentric such that rotational engagement of the lip and the cam generate a similar oscillation of the quill.

Figure 1:
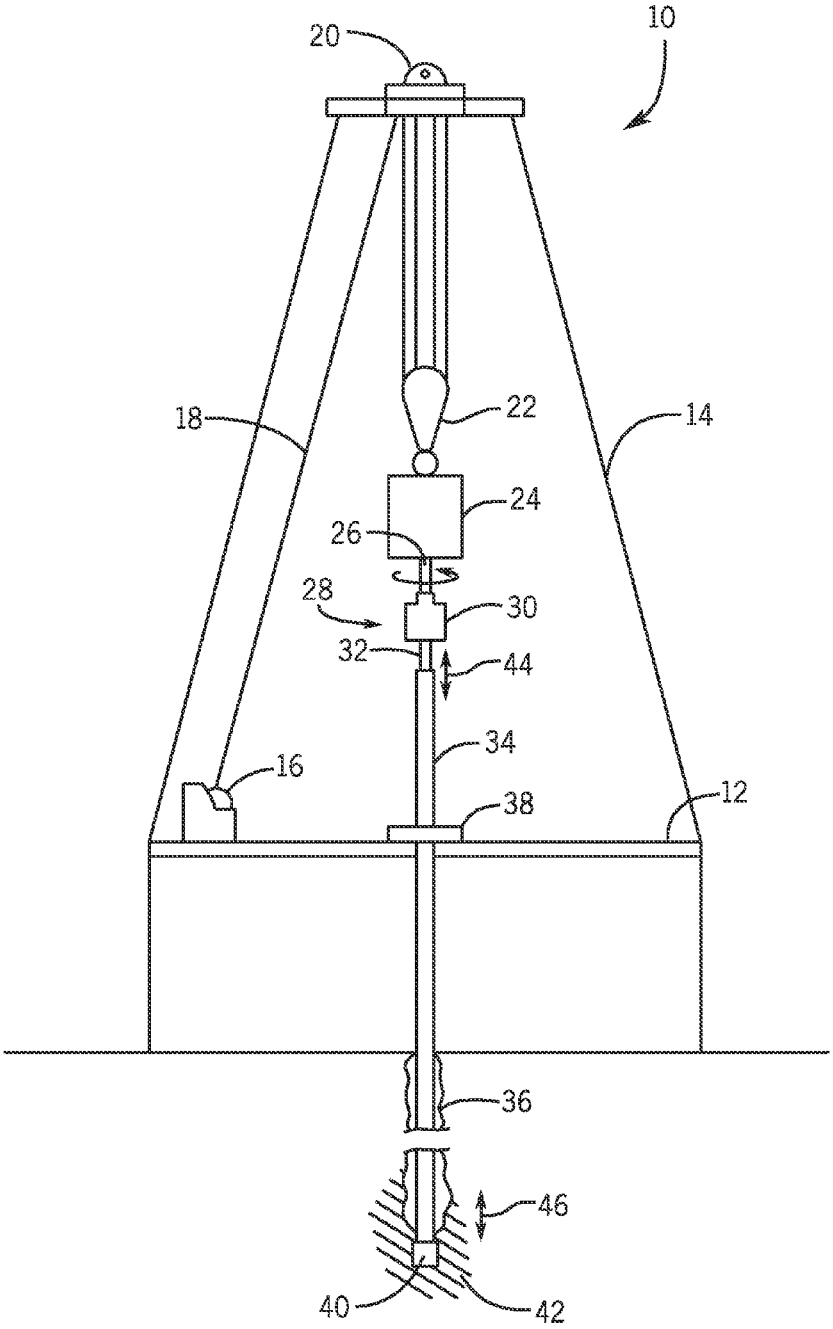
FIG. 1 is a schematic of a well being drilled in accordance with present techniques.

Turning now to the drawings, FIG. 1 is a schematic representation of a drilling rig 10 in the process of drilling a well in accordance with present techniques. The drilling rig 10 features an elevated rig floor 12 and a derrick 14 extending above the floor 12. A drawworks 16 supplies drilling line 18 to a crown block 20 and traveling block 22 in order to hoist various types of drilling equipment above the rig floor 12. The traveling block 22 supports a top drive 24, which features a quill 26 used to turn tubular or other drilling equipment. The quill 26 is coupled with a resonant extractor 28 in accordance with present embodiments. The resonant extractor 28 features a housing 30 for various components configured to generate oscillation of an extractor quill 32, which extends from the housing 30 and is configured to couple with tubular or drilling equipment. In the illustrated embodiment, the extractor quill 32 of the extractor 28 is connected with a tubular that forms the top length of a drill string 34. The tubular may be a length of casing, drill pipe, or the like and the drill string 34 is the total length of connected casing, drill pipe or the like that extends into a well bore 36 at a given moment.

While a new tubular length is being attached to the drill string 34, the drill string 34 may be held stationary with respect to the rig floor 12 by a set of slips 38. In order to advance the well bore 36 to greater depths, the drill string 34 features a bottom hole assembly (BHA), which includes a drill bit 40 for crushing or cutting rock away from a formation 42. In instances where the drill bit 40 becomes stuck in the formation 42, or the drill string 34 becomes stuck in the well bore 36 after remaining stationary for a long period of time, the resonant extractor 28 may be used to remove the drill string 34 from its stuck position. That is, the resonant extractor 28 may convert rotational motion provided by the top drive 24 to oscillating motion along an axis of the drill string 34, as indicated by arrows 44. Such oscillating motion may travel the length of the drill string 34 and work to dislodge the stuck drill bit 40 as well, as indicated by arrows 46. The extractor 28 may also be used during drilling processes when the drill string 34 is not in a stuck position, oscillating the drill string 34 to repeatedly force the drill bit 40 further into the formation 42. It should be noted that FIG. 1 is merely a representative embodiment, and certain illustrated features may be different in other embodiments. For example, various different embodiments of the extractor 28 are discussed in greater detail below. In addition, the conversion of rotary to vertically oscillating motion may take place at any point throughout the length of the drill string 34 and may be imparted to the BHA. Indeed, the resonant extractor 28 may be placed anywhere on the drill string 34 such that the point where the oscillating energy is being delivered may be any stuck point along the length of the drill string 34. Similar to the current use of down-hole and surface jars, the present embodiments provide for down-hole and surface resonant extractors.

It should be noted that the drilling rig 10 illustrated in FIG. 1 is intentionally simplified to focus on the extractor 28 described in the present disclosure. Many other components and tools may be employed during the various periods of formation and preparation of the well bore 36. Similarly, as will be appreciated by those skilled in the art, the environment of the well bore 36 may vary widely depending upon the location and situation of the formations of interest. For example, rather than a surface (land-based) operation, the well bore 36 may be formed under water of various depths, in which case the topside equipment may include an anchored or floating platform.

Figure 2:
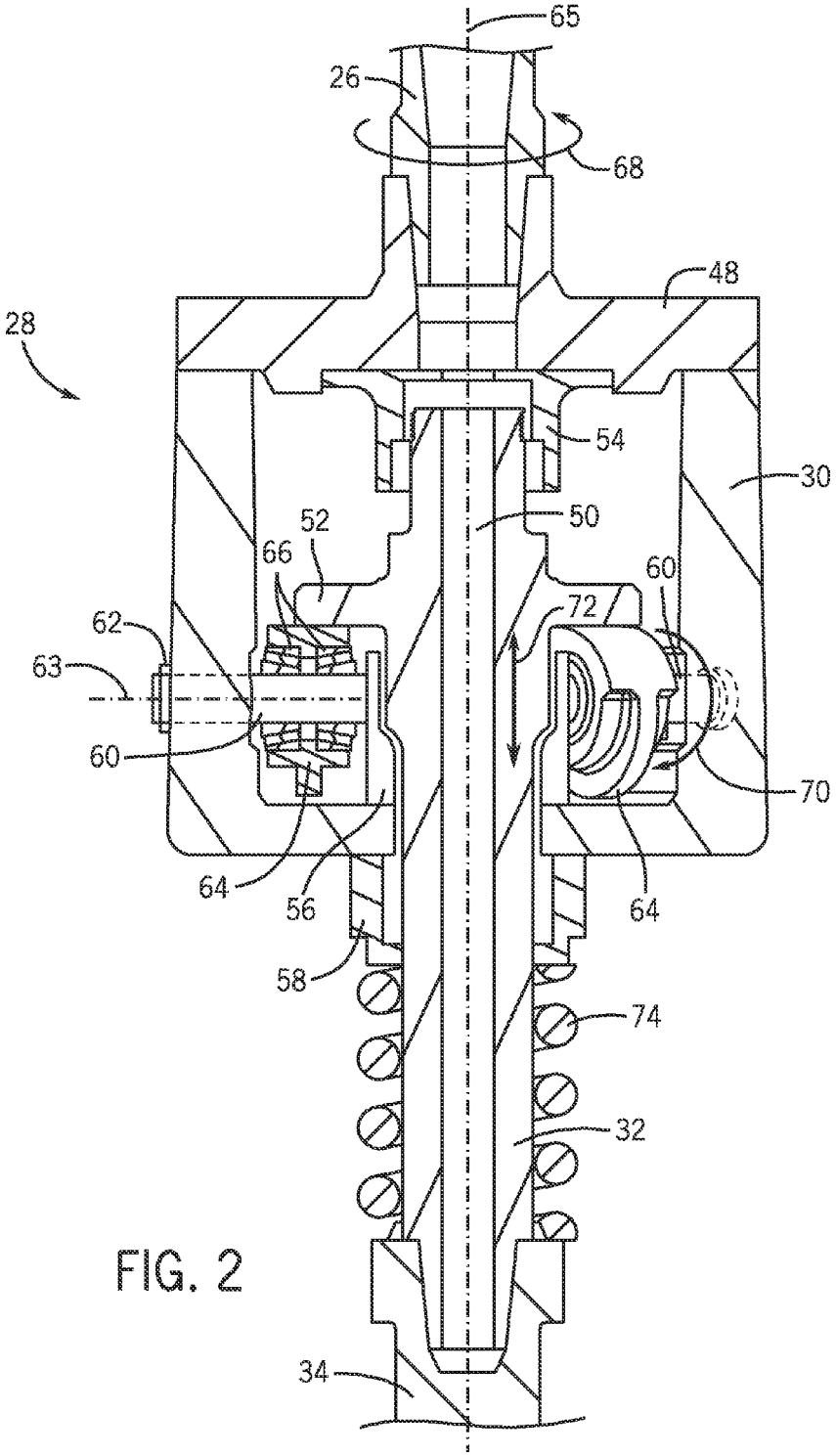
FIG. 2 is a cutaway view of an improved resonant extractor in accordance with present techniques.

FIG. 2 illustrates an exemplary embodiment of the resonant extractor 28 using the rotation of the top drive quill 26 to oscillate the drill string 34. The resonant extractor 28 includes a rotational component, which may be the housing 30, configured to rotate with the top drive quill 26. An oscillation component, such as the extractor quill 32, may be coupled with the rotational component and coupled with tubular or other drilling equipment. In the illustrated embodiments, the rotational component is the housing 30 while the oscillation component is the extractor quill 32. However, in other embodiments, the rotational component may be the extractor quill 32 and the oscillation component may be the housing 30. That is, the extractor quill 32 may be coupled with the rotating top drive quill 26 and the housing 30 may be coupled with the tubular or drilling equipment, such that rotation of the extractor quill 32 facilitates vertical oscillation of the housing 30 and the attached drill string 34.

In FIG. 2, the housing 30 of the resonant extractor 28 includes a top surface 48 bolted into other features of the housing 30 to make inner components of the extractor 28 accessible for maintenance or repairs via removal of the top surface 48. The top surface 48 may be coupled with the top drive quill 26 via threads, as the top drive quill 26 may be threaded to allow for a direct coupling with drill pipe when the extractor 28 is not in use. This coupling may ensure that the motor of the top drive 24 facilitates the rotation of the housing 30 as it drives the rotation of the top drive quill 26. As the energy transferred from the top drive 24 via the top drive quill 26 may be sufficient for rotating the housing 30, which is a relatively large component of the extractor 28, the energy may also be sufficient for initiating and maintaining the movement of components within the housing 30.

In addition to the housing 30, the extractor 28 features the extractor quill 32 extending from the housing 30, which is designed to couple with an upper tubular of the drill string 34 or other drilling equipment. The extractor quill 32 may include a channel 50 for conveying drilling fluid that is pumped from the top drive quill 26 down through the drill string 34. A lip 52 extending from the extractor quill 32 maintains contact with components inside the housing 30 in order to facilitate the vertical oscillatory motion of the extractor quill 32, as will be described in detail below. In the illustrated embodiment, the lip 52 forms part of the extractor quill 32, but in other embodiments the lip 52 may be a separate component positioned around and capable of engaging or coupling with an otherwise generally cylindrical extractor quill 32.

In order to prevent the extractor quill 32 from rotating as the housing 30 rotates, the extractor quill 32 may be supported within and around the housing 30 by various support structures 54, 56, and 58. The structures 54, 56, and 58 may be mounted on the housing 30, such that they encircle the extractor quill 32 at various positions along the vertical length of the extractor quill 32. Bearings (not shown) may be positioned in the spaces between the support structures 54, 56, and 58 and the extractor quill 32, allowing the extractor quill 32 to remain properly aligned as the housing 30 turns about the extractor quill 32. These bearings may also allow for the vertical up and down motion of the extractor quill 32 relative to the housing 30. In one embodiment, the support structure 56 may be actuated vertically in order to tune the amplitude of oscillating motion imparted to the extractor quill 32.

An inner assembly of engagement features transfers motion from the housing 30 to the extractor quill 32. A first engagement feature of the rotational component may include one or more shafts 60 coupled between the housing 30 and the support structure 56. The illustrated embodiment shows the shafts 60 coupled to the outside surface of the housing 30 via a nut 62, but the shafts 60 may be coupled to the housing in other arrangements as well, such as integral with or attached to an inside surface of the housing 30 or attached via a different coupling mechanism. The shafts 60 may extend into the housing 30 such that a longitudinal axis 63 of each shaft 60 is oriented transverse to a vertical axis 65 about which the housing 30 rotates. Further, the shafts 60 may be held in a fixed circumferential position relative the housing 30 such that, as the housing 30 rotates about the vertical axis 65, the shafts 60 revolve about the same axis 65 and at the same rate. A second engagement feature of the oscillation component may include an eccentric cam 64 positioned on each of the shafts 60 such that the cams 64 may rotate freely about the shafts 60 while maintaining contact with the lip 52 extending from the extractor quill 32. Roller bearings 66 may be placed between the cams 64 and shafts 60 to provide added stability to the cams 64 as they rotate about the respective shafts 60. The roller bearings 66, which are cylindrical tubes used to form a rolling contact surface between adjacent structures, allow the eccentric cams 64 to rotate about the shafts 60 with significantly reduced friction. Although the illustrated embodiment shows the engagement features as eccentric cams 64 disposed on shafts 60, other engagement features may be employed. In other embodiments, such as when the extractor quill 32 is the rotational component and the housing 30 is the oscillation component, the shaft 60 may be the engagement feature of the oscillating housing 30 and the cam 64 may be the engagement feature of the rotating extractor quill 32. In another embodiment, the shaft or shafts 60 may be coupled to the extractor quill 32 by means of carrier brackets such that the eccentric cams 64 remain in constant rotational orientation with the extractor quill lip 52 as they roll on a flat surface of the extractor housing 30.

During operation of the extractor 28, the housing 30 may rotate in response to the rotation of the top drive quill 26, as indicated by arrow 68. As mentioned previously, the rotation of the housing 30 may lead the shafts 60 to revolve about the same vertical axis 65, as the shafts 60 may be fixed radially to the housing 30. The eccentric cams 64 disposed on the shafts 60 may maintain contact with the lip 52 extending from the extractor quill 32, supporting the extractor quill 32 as the housing 30 rotates. Thus, the eccentric cams 64 are positioned on the shafts 60, which revolve about the vertical axis 65 as the housing 30 rotates, and the cams 64 contact the extractor quill 32, which does not rotate with the housing 30. As the housing 30 rotates, the cams 64 may be forced to rotate about the shafts 60, as indicated by arrow 70, in order to maintain their positions on the revolving shafts 60 while also maintaining contact with the lip 52. The cams 64 may be arranged and timed such that the same position on the circumference of each eccentric cam 64 may be contacting the lip 52 at a given time. It should be noted that the cams 64 may include gripping features on the engaging or contacting surfaces to facilitate rotation. If timing is maintained, the eccentric cams 64 rotating about the shafts 60 will raise and lower the lip 52 relative to the housing 30 due to the variation in dimensions of the cams 64. Thus, the extractor quill 32 will also be raised and lowered relative to the housing 30 as the housing 30 rotates. Consequently, the rotation of the housing 30 about the vertical axis may result in the motion of the extractor quill 32 in a vertical direction, as indicated by arrow 72.

In the illustrated embodiment, a spring 74 has been placed between the drill string 34 and the support structure 58 beneath the housing 30. In addition to increasing the stiffness of the extractor quill 32, the spring 74 may apply a force to both the drill string 34, pulling the extractor quill 32 downward, and the support structure 58, pushing the housing 30 and the shafts 60 upward. This may force the lip 52 extending from the extractor quill 32 into contact with the cams 64, preventing the cams 64 from slipping relative to the lip 52 and, consequently, maintaining the timing between the cams 64. Other methods may be used to maintain non-slipping contact between the cams 64 and the lip 52 in order to improve timing between the cams 64. For example, teeth may be cut into the cams 64 and a bottom surface of the lip 52 so the components mesh, without slipping, to ensure alignment and timing of the cams 64 with respect to one another. Although the illustrated embodiment shows multiple cams 64 placed on multiple shafts 60, the extractor 28 may operate with as few as one cam 64 placed on one shaft 60. However, the use of multiple cams 64 and shafts 60 may provide additional balance and stability to the extractor 28, particularly when arranged in a radial pattern to balance the weight distributed within a cylindrical housing 30.

Figure 3:
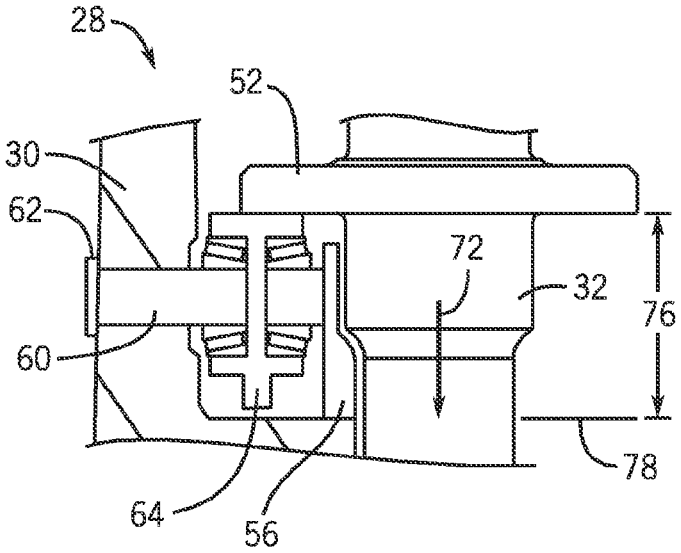
FIG. 3 is a schematic cross-sectional view of certain components of a resonant extractor lowering a quill in accordance with present techniques.
Figure 4:
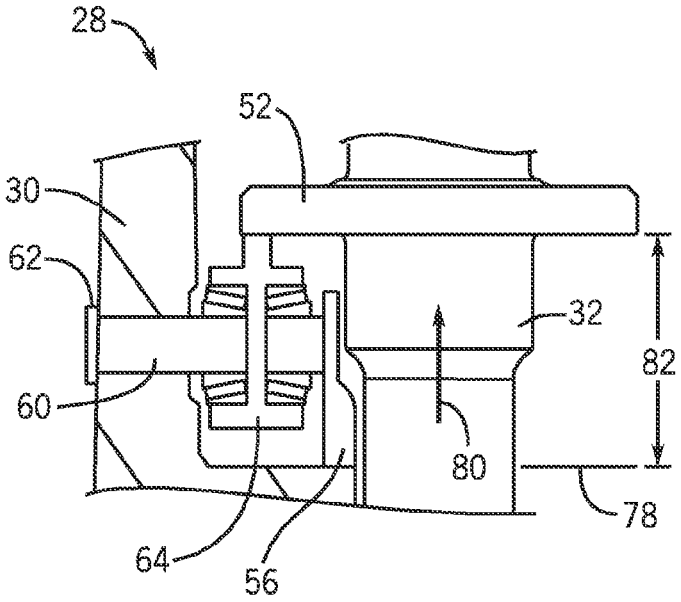
FIG. 4 is a schematic cross-sectional view of certain components of a resonant extractor raising a quill in accordance with present techniques.

FIG. 3 and FIG. 4 each illustrate certain components of the extractor 28 being used to move the extractor quill 32 up or down. Due to the eccentricity of the cam 64, the vertical position of the extractor quill 32 may be affected by the orientation of the cam 64 about the shaft 60. For example, when a relatively shorter orientation of the cam 64 contacts the lip 52 extending from the extractor quill 32, as shown in FIG. 3, the extractor quill 32 is brought to a relatively lower position in the vertical direction, as indicated by the arrow 72. In this lowered position, the lip 52 may be supported a distance 76 above an interior surface 78 of the housing 30. Alternatively, the cam 64 may be rotated 180 degrees about the shaft 60 to contact the lip 52 with a relatively extended orientation of the cam 64, as shown in FIG. 4, bringing the extractor quill 32 to a relatively raised position as indicated by arrow 80. In this raised position, a distance 82 between the lip 52 and the interior surface 78 may be significantly larger than the distance 76 from the lowered position. Continually rotating the cam 64 between the orientations (raised and lowered position) may oscillate the extractor quill 32 and, consequently, the drill string 34. Such oscillation may dislodge the drill string 34 from the formation 42, using the power available through the top drive 24 of the drilling rig 10 instead of an auxiliary power supply.

Figure 5:
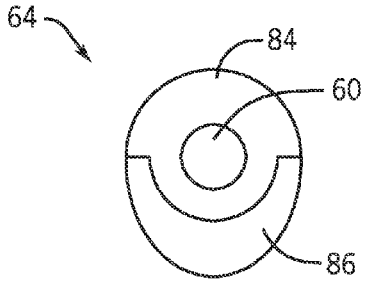
FIG. 5 is a side view of an eccentric cam in accordance with present techniques.

A detailed side view of the eccentric cam 64 is provided in FIG. 5. The cam 64 exhibits eccentricity about the shaft 60 upon which the cam 64 is mounted, featuring an eccentric shape that is not centered on the shaft 60. It should be noted that the extractor 28 applies vertical movement to the drill string 34 by directly displacing the drill string 34, and not by applying an inertial force near the drill string 34 to urge the oscillating motion. In order to apply such oscillating motion to the drill string 34 without applying an eccentric force, the mass of the cams 64 used to move the extractor quill 32 are concentric about the shaft 60. That is, the center of mass of each cam 64 is located at the center of the aperture through the cam 64 that is positioned on the shaft 60. In order to maintain concentricity of mass and eccentricity of circumference, the cam 64 may include a wide portion 84 and a thin portion 86. In the illustrated embodiment, the wide portion 84 includes the relatively shorter end and a portion of the relatively extended end of the cam 64, and the thin portion 86 reaches to the end of the relatively extended end of the cam 64. In some embodiments, the thin portion 86 may include an expanded contact surface to provide substantially equal contact surface throughout rotation of the cam 64. This combination of eccentric geometry and concentric mass may also be achieved by the provision of cams 64 manufactured of two different materials of substantially different densities or by cams 64 of relatively equal width but with substantial material removed as in the use of lightening holes.

Figure 6:
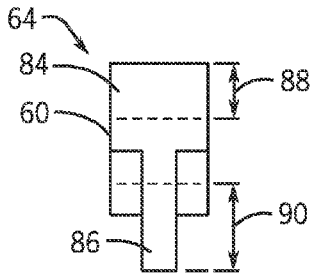
FIG. 6 is a front view of an eccentric cam in accordance with present techniques.

FIG. 6 illustrates the same eccentric cam 64 as viewed from the front, clearly showing the difference in thickness of the wide portion 84 compared to the thin portion 86. Although the center of mass is balanced around the shaft 60, a distance 88 from the shaft 60 to the outer surface of the wide portion 84 is noticeably smaller than a distance 90 from the shaft 60 to the outer surface of the thin portion 86. The difference between these distances 88 and 90 is the total distance that the extractor quill 32 may be moved up and down along the quill axis as the cams 64 turn about the shafts 60. In order to change the distance of oscillation, the geometry of the cams 64 may be scaled up or down. Alternatively, the thin portion 86 may be machined wider or thinner and, in order to maintain the center of mass, shortened or extended from the shaft 60, thereby altering the distance 90. In addition, the cams 64 may feature multiple thin portions 86 extending away from the shaft 60, in order to provide greater stability to the supported lip 52 extending from the quill. Other variations in cam geometry are possible in accordance with present embodiments.

Figure 7:
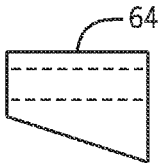
FIG. 7 is a front view of an eccentric cam with variable geometric eccentricity in accordance with present techniques.

FIG. 7 illustrates a cam 64 having a geometry in accordance with one embodiment. Specifically, in the embodiment illustrated by FIG. 7, the eccentricity of the cam 64 varies along the axis of the cam 64. In such an embodiment, vertical movement of the support structure 56 may result in a pivoting motion about the shaft-end support 62 such that the orientation of the shaft 60 remains at a fixed circumferential position relative to the housing 30 but not parallel to a horizontal plane. This change in orientation may cause the lip 52 extending from the extractor quill 32 to contact a different axial location on the cam 64 such that the eccentricity of the line of contact between the cam 64 and the lip 52 is varied from a minimum, which may or may not be zero, to a maximum. In one embodiment, the cam 64 of FIG. 7 may be utilized with a corresponding contact feature (e.g., lip) configured such that it contacts the cam 64 at different axial locations depending on rotational position.

During operation of the extractor 28, it may be beneficial to oscillate the extractor quill 32 at a desired frequency, such as the longitudinal resonant frequency of the drill string 34. Oscillating the drill string 34 at its longitudinal resonant frequency may minimize energy losses down the length of the drill string 34 and, therefore, apply the greatest amount of energy to the drill bit 40 or stuck point. The amplitude of oscillation and force at the drill bit 40 or stuck point will be highest at this frequency, making the extraction process more efficient overall. Throughout the drilling process, new lengths may be added to the drill string 34 over time, changing the total length of the drill string 34 as well as the longitudinal resonant frequency of the drill string 34. In addition, certain aspects of the drill string 34 including weight, material, thickness of drill pipe, and the like may affect the longitudinal resonant frequency. To account for variations in properties between different drill strings 34 and for the changing length of any one drill string 34, the top drive 24 may turn the housing 30 of the extractor at different speeds until the appropriate frequency is reached. In this way, the extractor 28 effectively tunes the motion of the extractor quill 32 to the resonant frequency of the particular drill string 34.

Figure 8:
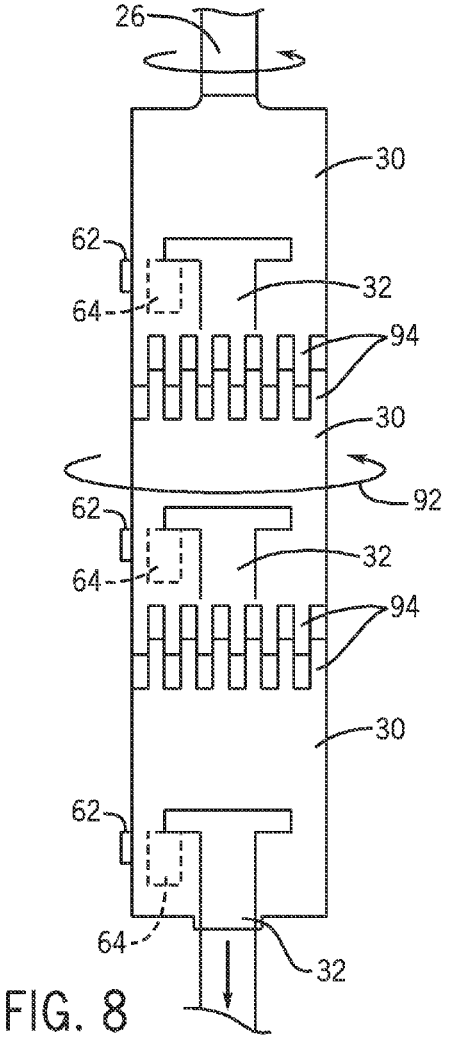
FIG. 8 is a schematic of multiple resonant extractors combined in series in accordance with present techniques.

In addition to tuning the vertical oscillation to a desired frequency, it may be desirable to facilitate vertical oscillation of the drill string 34 at a desired amplitude. Dislodging the drill bit 40 or stuck point of a given drill string may require an amplitude of oscillation applied at the extractor quill 32 that is directly related to the length of the drill string 34. Thus, a relatively shorter drill string 34 may require a small amplitude of oscillation applied at the extractor quill 32. Since the geometry of the eccentric cams 64 determines the amplitude of oscillation of the extractor quill 32, multiple interchangeable eccentric cams 64 may be available with the extractor 28. The top surface 48 may be removed from the housing 30, as discussed above, to facilitate changing the cams 64 so that the appropriate amplitude of oscillating motion may be provided to the drill string 34. However, it may be difficult for the rotating housing 30 to apply the energy required to turn a significantly large cam because the moment arm of the weight of the drill string 34 acting on the cam 64 may be so large that the cam 64 resists rotation. To apply the desired large amplitude to the drill string 34, multiple housings 30 may be connected in series, each housing 30 containing relatively small eccentric cams 64 disposed on corresponding shafts 60, as illustrated in FIG. 8. The housing 30 coupled with the top drive quill 26 may turn, causing the enclosed cam 64 to rotate and apply oscillatory motion to the corresponding extractor quill 32, which is coupled with the next housing 30 or, in the case of the last housing 30, the attached drill string 34. The first housing 30 may transfer the rotation provided by the top drive 24 to the other connected housings 30, as indicated by arrow 92, via teeth 94 or any other connection capable of coupling the housings 30 rotationally while allowing translation of the housings 30 relative to each other in the direction of the rotational axis. By using the three housings 30 shown, instead of only one, the extractor 28 is able to apply the desired amplitude of oscillation using smaller eccentric cams 64 that may be easier for the top drive 24 to turn.

The illustrated embodiment shows the cam 64 positioned on the shaft 60 in each housing 30 in the same relative orientation about the corresponding shaft 60, making each extractor quill 32 oscillate in phase. However, multiple housings 30 may be connected in series with the eccentric cams 64 of each housing 30 positioned at different relative orientations about the corresponding shafts 60, causing the extractor quills 32 to oscillate out of phase. The relative oscillations of the extractor quills 32 may sum to oscillate the drill string 34 with smaller amplitude than the amplitude available when oscillating the extractor quills 32 in phase. In fact, the cams 64 may be repositioned within the housings 30 in order to tune the amplitude of oscillation of the drill string 34 to the appropriate amplitude for the current position of the drill string 34 within the well bore 36. Such relative phase orientation may be changed in a continuous fashion on-the-fly to result in a tunable amplitude oscillator to match the longitudinal stiffness of the drill string 34.

Figure 9:
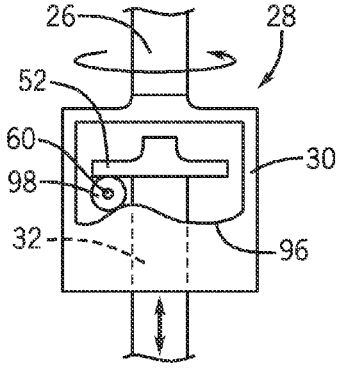
FIG. 9 is a schematic of a second embodiment of a resonant extractor in accordance with present techniques.
Figure 10:
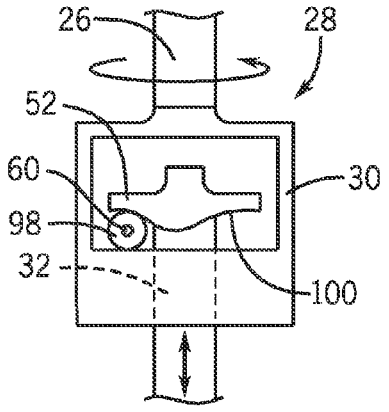
FIG. 10 is a schematic of a third embodiment of a resonant extractor in accordance with present techniques.
Figure 11:
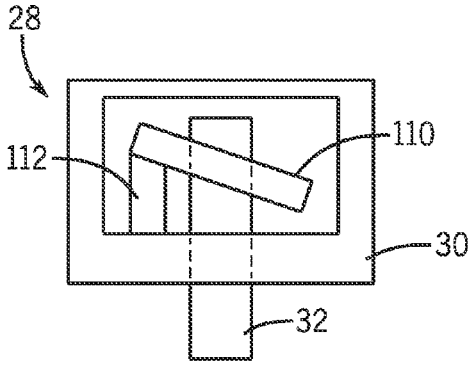
FIG. 11 is a schematic of a fourth embodiment of a resonant extractor in accordance with present techniques.
Figure 12:
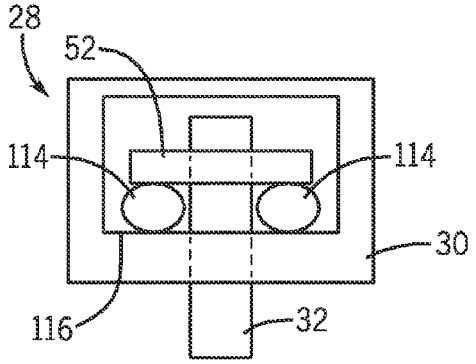
FIG. 12 is a schematic of a fifth embodiment of a resonant extractor in accordance with present techniques.

It should be noted that other embodiments of the extractor 28 may be possible using a housing and an assembly, which may include cams disposed on shafts, within the housing. For example, the housing 30 may include an asymmetric inner surface configured to maintain contact with a cam. FIG. 9 illustrates an extractor 28 in which the asymmetric inner surface of the housing 30 features a wavy track 96 formed in an interior surface of the housing 30 and the assembly includes a concentric cam 98 disposed on a shaft 60. In this embodiment, the shaft 60 maintains contact with the lip 52 extending from the extractor quill 32, causing the extractor quill 32 to oscillate up and down as the cam 98 rotates, following the wavy track 96. FIGS. 10 and 11 show other embodiments for facilitating the oscillating motion of the extractor quill 32, where the assembly includes an asymmetric lip extending from the extractor quill 32 and a structure coupled to and extending into the housing 30 that maintains contact with the asymmetric lip. As before, the extractor quill 32 from which the asymmetric lip extends may be either the oscillation component or the rotational component of the extractor 28, while the housing 30 may be the corresponding rotational component or oscillation component. The assembly of FIG. 10 features a concentric cam 98 disposed on the shaft 60, which is coupled to and extending into the housing 30, as in the first embodiment. The concentric cam 98 is configured to maintain contact with an asymmetric surface or wavy lip 100 extending from the extractor quill 32 in order to facilitate oscillation of the extractor quill 32. The asymmetric lip illustrated in FIG. 11 is a tilted flat surface 110 oriented such that a vector normal to the surface 110 is substantially not parallel to the axis of rotation of the housing 30. The tilted flat surface 110 may maintain contact with a rolling or sliding pedestal 112 circumferentially fixed to the housing 30 such that relative rotation between the extractor quill 32 and the housing 30 results in vertical motion of the extractor quill 32. This is essentially the end-case of the embodiment of FIG. 10 for a single wave per revolution. FIG. 12 shows another embodiment where a series of eccentric rollers 114 are guided to roll on a primarily circumferential path of a rotating inner surface 116 of the housing 30 such as to maintain rolling contact with both the housing 30 and the lip 52 extending from the extractor quill 32. This rolling motion between the rolling eccentric cams 114 and the inner surface 116 thus results in the vertical oscillating motion of the extractor quill 32 relative to the housing 30.

Figure 13:
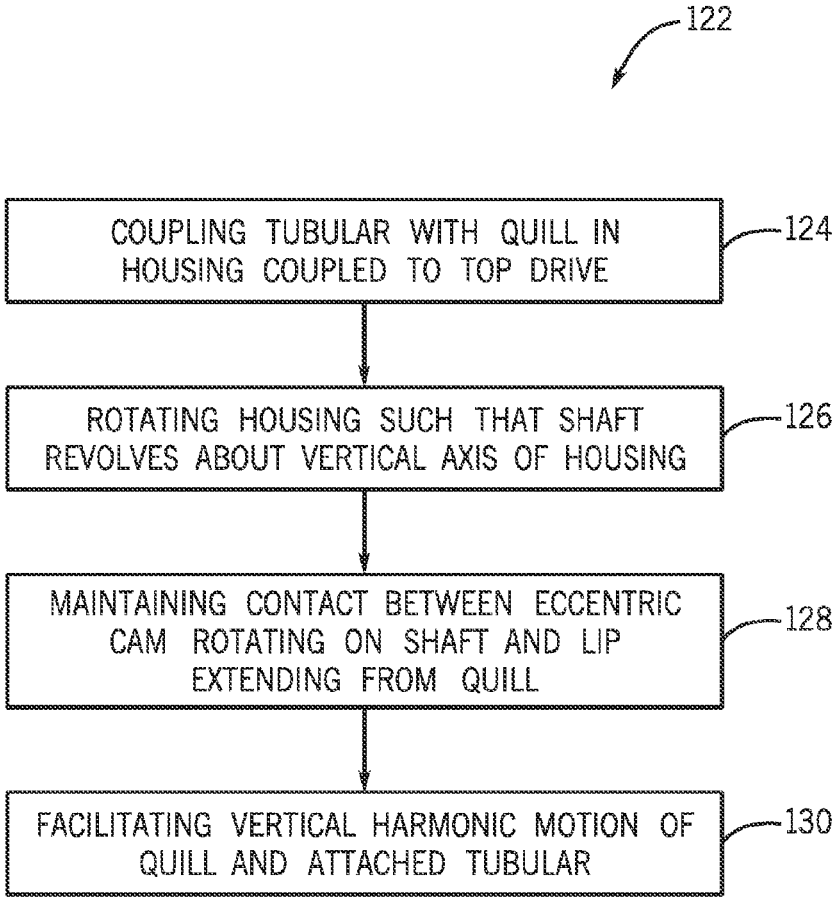
FIG. 13 is a process flow diagram of a method in accordance with present techniques.

FIG. 13 illustrates a method 122 in accordance with embodiments of the present disclosure. The method 122 includes maintaining a coupling between a tubular or other equipment and a quill, as represented by block 124. The quill may be at least partially located within a housing coupled with a top drive system of a drilling rig. Further, the method 122 includes rotating the housing such that a shaft revolves about a vertical axis of the housing, as represented by block 126. The shaft may be coupled to and extending into the housing substantially transverse the vertical axis of the housing so that, as the housing rotates about the vertical axis, the shaft revolves about the vertical axis of the housing. Further, as represented by block 128, the method 122 includes maintaining contact between an eccentric cam turning on the shaft and a lip extending from a quill. As the shaft revolves about the vertical axis, the cam rotates about the shaft to maintain contact with the lip. Still further, the method 122 includes facilitating vertical oscillating motion of the quill, as represented by block 130. Specifically, the eccentric cam may press against the lip extending from the quill, raising and lowering the lip as the cam rotates about the shaft. The oscillating motion of the quill may raise and lower the attached drill string to dislodge the drill string from a stuck position.

While only certain features of disclosed embodiments have been illustrated and described herein, many modifications and changes will occur to those skilled in the art. It is, therefore, to be understood that the appended claims are intended to cover all such modifications and changes as fall within the true spirit of the invention.

The invention claimed is:

1. A drilling system, comprising:

a rotational component configured to be coupled with a top drive such that the top drive facilitates rotation of the rotational component about a vertical axis, wherein the rotational component comprises a housing configured to be coupled with the top drive, wherein the top drive facilitates rotation of the housing about the vertical axis;

an oscillation component configured to be coupled with the rotational component and with tubular or equipment, wherein the oscillation component comprises a quill disposed at least partially in the housing and configured to be coupled with the tubular or equipment;

a first engagement feature of the rotational component comprising a cam disposed on a shaft; and a second engagement feature of the oscillation component comprising an asymmetric lip surface extending from the quill, wherein the cam and the asymmetric lip surface are configured to abut one another and maintain contact such that during rotation of the rotational component the oscillation component is oscillated along the vertical axis.

2. A drilling system, comprising:

a rotational component configured to be coupled with a top drive such that the top drive facilitates rotation of the rotational component about a vertical axis, wherein the rotational component comprises a housing configured to be coupled with the top drive, wherein the top drive facilitates rotation of the housing about the vertical axis;

an oscillation component configured to be coupled with the rotational component and with tubular or equipment, wherein the oscillation component comprises a quill disposed at least partially in the housing and configured to be coupled with the tubular or equipment;

a first engagement feature of the rotational component, wherein the first engagement feature comprises a shaft coupled to the housing and extending into the housing substantially transverse to the vertical axis and an eccentric cam disposed on the shaft; and a second engagement feature of the oscillation component, wherein the first and second engagement features are configured to abut one another and maintain contact such that during rotation of the rotational component the oscillation component is oscillated along the vertical axis, and wherein the second engagement feature comprises a lip extending from the quill and configured to maintain contact with the eccentric cam such that, when the housing rotates, the eccentric cam rotates to facilitate oscillating movement of the quill along an axis of the quill.

3. The drilling system of claim 2, comprising a plurality of eccentric cams disposed on a plurality of shafts coupled to and extending into the housing substantially transverse the vertical axis, the plurality of eccentric cams being configured to maintain contact with the lip extending from the quill.

4. The drilling system of claim 3, wherein the plurality of eccentric cams comprise a plurality of self-similar eccentric cams configured to each contact the lip extending from the quill at a similar point along a circumference of each of the plurality of cams with respect to a given time.

5. The drilling system of claim 3, wherein each of the plurality of shafts extend radially into a cylindrical housing.

6. The drilling system of claim 2, wherein the eccentric cam comprises a center of mass concentric with the shaft on which the eccentric cam is disposed.

7. The drilling system of claim 2, wherein the eccentric cam comprises an eccentric geometry that varies along an axis of the shaft.

8. The drilling system of claim 2, comprising the tubular coupled with the quill comprises a top portion of a drill string extending into a well and the eccentric cam is configured to facilitate oscillating movement of the quill at a longitudinal resonant frequency of the drill string.

9. The drilling system of claim 8, comprising a plurality of housings coupled in series between the top drive system and the drill string and wherein each housing contains an eccentric cam disposed on a shaft coupled to and extending into the housing in order to facilitate oscillating movement of the drill string at a given amplitude.

10. A drilling system, comprising:

a rotational component configured to be coupled with a top drive such that the top drive facilitates rotation of the rotational component about a vertical axis, wherein the rotational component comprises a quill configured to be coupled with the top drive, wherein the top drive facilitates rotation of the quill about the vertical axis;

an oscillation component configured to be coupled with the rotational component and with tubular or equipment, wherein the oscillation component comprises a housing disposed at least partially about the quill and configured to be coupled with the tubular or equipment;

a first engagement feature of the oscillation component, wherein the first engagement feature comprises a shaft coupled to the housing and extending into the housing substantially transverse to the vertical axis and an eccentric cam disposed on the shaft; and a second engagement feature of the rotational component, wherein the first and second engagement features are configured to abut one another and maintain contact such that during rotation of the rotational component the oscillation component is oscillated along the vertical axis, and wherein the second engagement feature comprises a lip extending from the quill such that, when the quill rotates, the eccentric cam rotates to facilitate oscillating movement of the housing along an axis of the housing.

11. A method, comprising:

maintaining a coupling between a tubular or equipment and a quill disposed at least partially in a housing coupled to a top drive system;

rotating the housing about a vertical axis of the housing via the top drive system such that a shaft coupled to and extending into the housing substantially transverse the vertical axis of the housing revolves about the vertical axis of the housing;

maintaining contact between an eccentric cam disposed on the shaft and a lip extending from the quill such that, as the shaft revolves about the vertical axis of the housing, the eccentric cam rotates about an axis of the shaft; and facilitating oscillating movement of the quill and the tubular or equipment along an axis of the quill as the eccentric cam rotates.

12. The method of claim 11, comprising maintaining contact between a plurality of eccentric cams disposed on a plurality of shafts and the lip extending from the quill.

13. The method of claim 11, wherein facilitating oscillating movement of the tubular comprises facilitating oscillating movement of a drill string extending into a well.

14. The method of claim 13, comprising configuring a speed of rotation of the housing by the top drive in order to facilitate oscillating movement of the drill string at a longitudinal resonant frequency of the drill string.

15. The method of claim 11, comprising coupling with more than one housing in series between the top drive system and the drill string, each housing including an eccentric cam disposed on a shaft extending into the housing substantially transverse the vertical axis, in order to facilitate oscillating movement of the drill string at a given amplitude.

16. A drilling system, comprising:

a rotational component configured to be coupled with a top drive, wherein the top drive facilitates rotation of the rotational component about a vertical axis and wherein the rotational component comprises a housing;

an oscillation component engaged with the rotational component and configured to be coupled with tubular or drilling equipment, wherein the oscillation component comprises a quill at least partially disposed in the housing; and an assembly configured to maintain contact with both the housing and the lip extending from the quill, wherein the assembly is configured to facilitate vertical oscillatory motion of the oscillation component as the rotational component rotates, and wherein the assembly comprises an eccentric cam disposed on a shaft and configured to maintain contact with the lip extending from the quill, the shaft being coupled to and extending into the housing substantially transverse to the vertical axis.

17. A drilling system comprising:

a rotational component configured to be coupled with a top drive, wherein the top drive facilitates rotation of the rotational component about a vertical axis;

an oscillation component engaged with the rotational component and configured to be coupled with tubular or drilling equipment; and an assembly configured to maintain contact with both the rotational component and the oscillation component, wherein the assembly is configured to facilitate vertical oscillatory motion of the oscillation component as the rotational component rotates, and wherein the assembly comprises an asymmetric inner surface of the rotational component and a cam disposed on a shaft, the cam being configured to maintain contact with the asymmetric inner surface and the shaft being configured to maintain contact with a lip extending from the oscillation component.

* * * * *